US007104876B1

(12) United States Patent
Lin

(10) Patent No.: US 7,104,876 B1
(45) Date of Patent: Sep. 12, 2006

(54) CUTTER-GRINDER

(76) Inventor: Kun-Meng Lin, No. 89, Huanan Road, Qiaotou Village, Huatan Shian, Changhua Hsien (TW)

( * ) Notice: Subject to any disclaimer, the term of this patent is extended or adjusted under 35 U.S.C. 154(b) by 0 days.

(21) Appl. No.: 11/156,481

(22) Filed: Jun. 21, 2005

(51) Int. Cl.
*B24B 25/00* (2006.01)
*B24B 19/00* (2006.01)

(52) U.S. Cl. ..... 451/312; 451/321; 451/320; 451/367

(58) Field of Classification Search ..... 451/312, 451/321, 367, 45, 54, 349, 370, 371, 378, 451/380, 405, 72
See application file for complete search history.

(56) References Cited

U.S. PATENT DOCUMENTS 1,647,203 A * 11/1927 Smith ..... 451/164
1,770,538 A * 7/1930 Warner ..... 451/321
1,945,201 A * 1/1934 Periolat ..... 451/321
2,088,056 A * 7/1937 Foster ..... 451/320
2,128,591 A * 8/1938 McGill ..... 451/321
2,131,626 A * 9/1938 Keith ..... 451/321
2,376,477 A * 5/1945 Craven ..... 451/512
2,458,257 A * 1/1949 Donovan ..... 451/321
3,950,899 A * 4/1976 Gilbert ..... 451/370
4,512,111 A * 4/1985 Childers ..... 451/320
4,733,501 A * 3/1988 McLean ..... 451/380
5,582,542 A * 12/1996 Stein ..... 451/367
5,810,649 A * 9/1998 Oar et al. ..... 451/378
6,832,737 B1 * 12/2004 Karlsson et al. ..... 241/100
6,899,606 B1 * 5/2005 Liao et al. ..... 451/184
6,926,596 B1 * 8/2005 Tarris ..... 451/367

* cited by examiner

*Primary Examiner*—David B. Thomas
*Assistant Examiner*—Robert Scruggs
(74) *Attorney, Agent, or Firm*—Rabin & Berdo, P.C.

(57) ABSTRACT

An innovative cutter-grinder comprised of a base, a cutter holder, and a mobile base plate; the base plate being mounted with emery cloth before being placed on a deck of the frame to secure the emery cloth and allow easy replacement of the emery cloth; the cutter holder adapted with a roller at bottom retaining a blade for the user to hold the cutter holder to roll back and forth on the base plate to grind the cutter against the emery cloth; and an angle set plate being inserted onto slots respectively provided on both sides of the deck allowing the adjustment of the grinding angle.

4 Claims, 11 Drawing Sheets

CUTTER-GRINDER

BACKGROUND OF THE INVENTION (a) Field of the Invention

The present invention is related to an innovative cutter-grinder, and more particularly to one that allows safe grinding and adjustment of the angle of the blade of the cutter to be ground while maintaining good grinding quality.

(b) Description of the Prior Art

Whereas after having been used for a certain time, the blade or the cutting edge of a cutter, e.g., the stock of a plane, tends to get worn out or dulled; a grinder or a grindstone is usually needed to restore the blade to its sharp status.

However, inconsistent grinding quality due to failure in maintaining a firm contact between the blade and the surface of the grinder has been always the biggest problem found with the conventional grinder or grindstone. Furthermore, holding the cutter to engage in reciprocal grinding motion increases the chance of contacting the grinder and the blade, resulting in safety concerns of getting one's hand cut.

SUMMARY OF THE INVENTION

The primary purpose of the present invention is to provide a cutter grinder that is safe to use without compromising the grinding quality.

Another purpose of the present invention is to provide a cutter grinder that permits replacement of an emery cloth inside the grinder.

Another purpose yet of the present invention is to provide a cutter grinder that provides safe grinding and better grinding quality. To achieve the purpose, a cutter holder adapted at its bottom a roller to allow the user executes firm and consistent reciprocal grinding by holding the cutter holder to control the roller flushed against the surface of the grinder.

Another purpose yet of the present invention is to provide a cutter grinder that has disposed on both sides of a deck to the base of the cutter grinder multiple slots to receiver insertion of an angle adjustment plates to adjust for the grinding angle as desired.

Another purpose yet of the present invention is to provide a cutter grinder that a sink containing fresh water is further adapted to either side of the grinder to dissipate the heat and wash away dusts generated in the course of grinding.

DETAILED DESCRIPTION OF THE PREFERRED EMBODIMENTS

Figure 1:
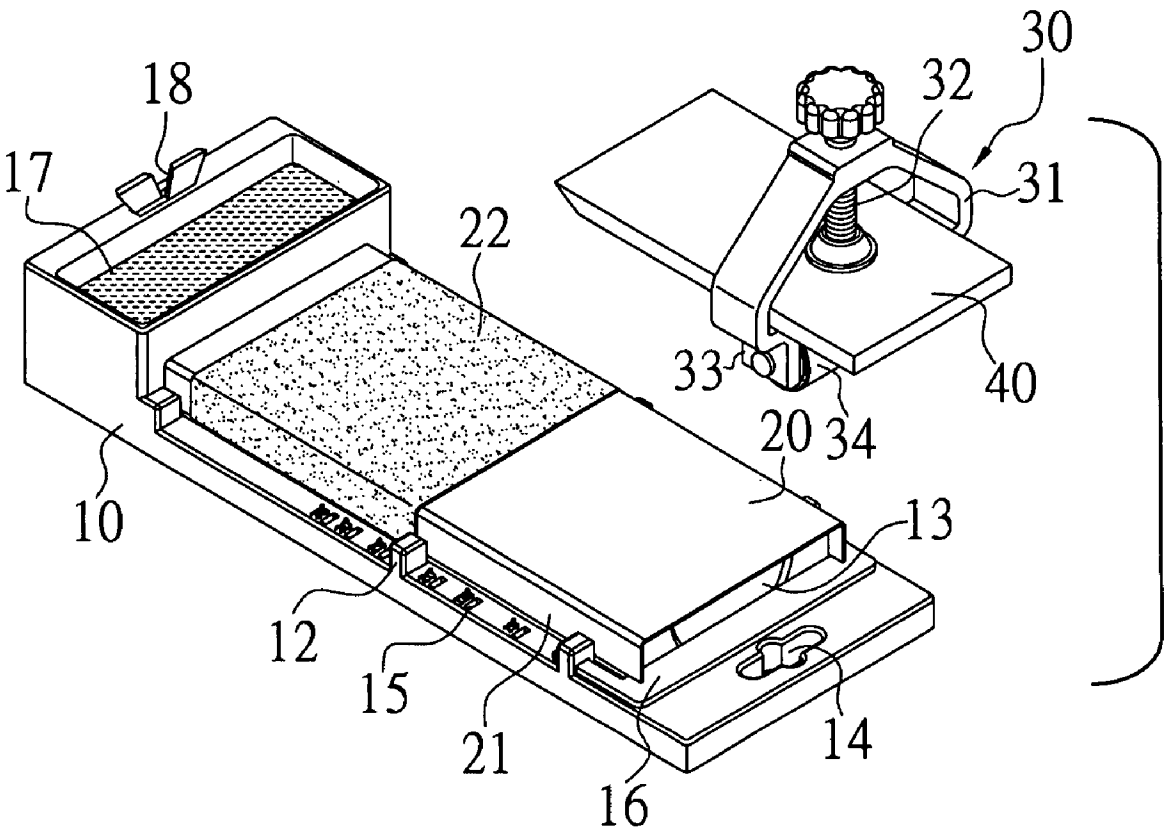
FIG. 1 is a schematic view showing the construction of a first preferred embodiment of the present invention.
Figure 2:
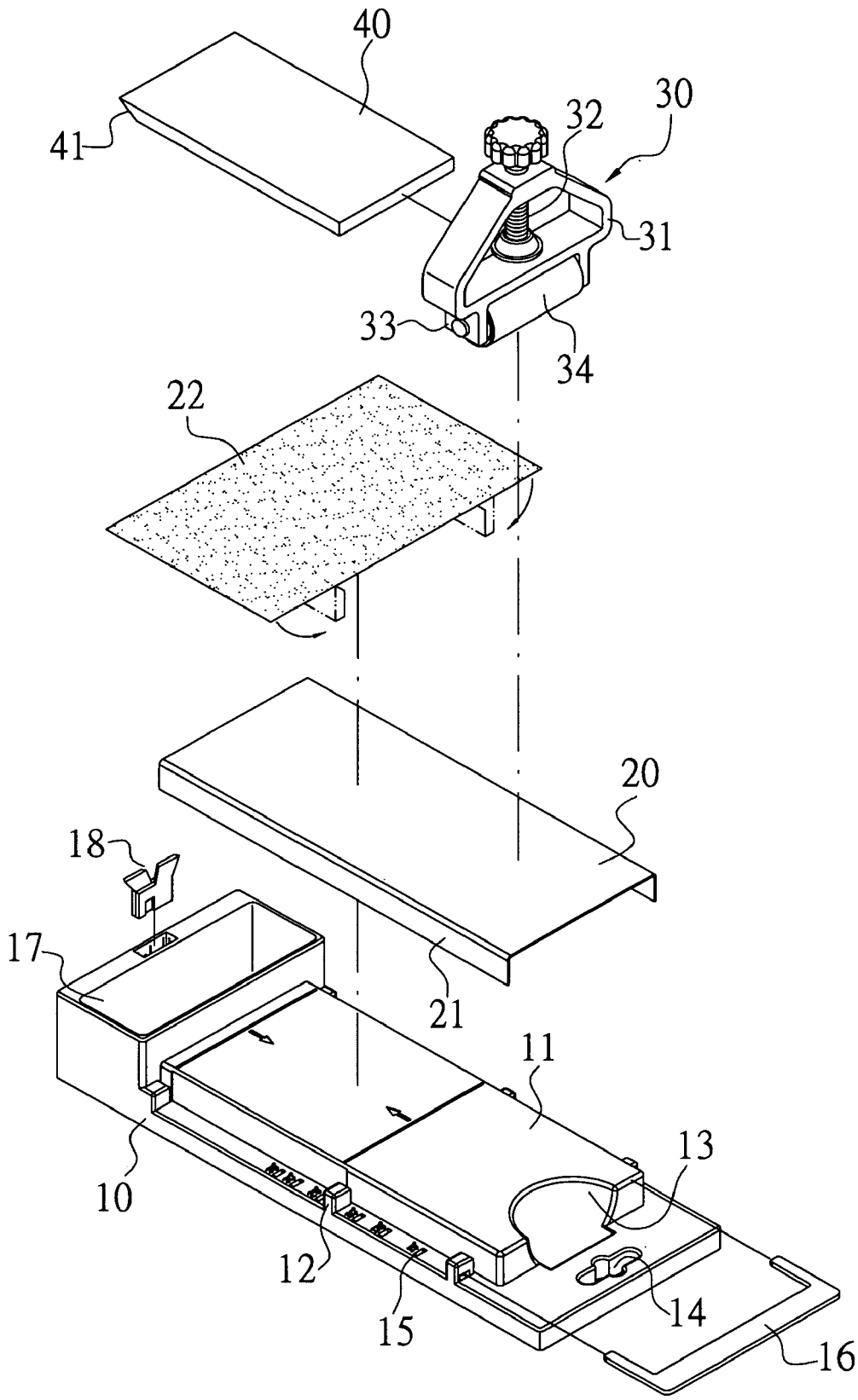
FIG. 2 is an exploded view of the construction of the first preferred embodiment of the present invention.
Figure 3:
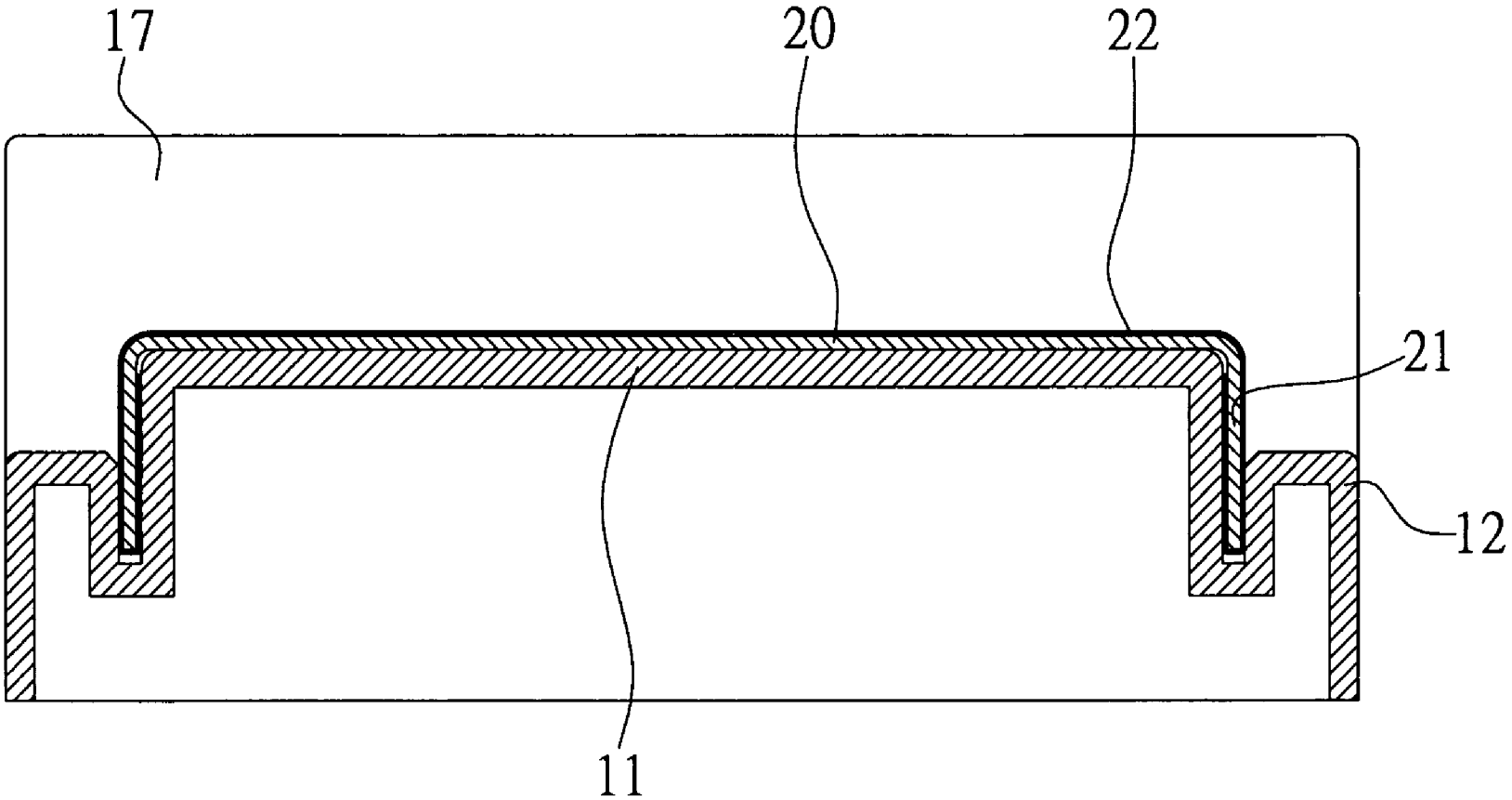
FIG. 3 is a sectional view of a cut-away of the first preferred embodiment of the present invention.
Figure 5:
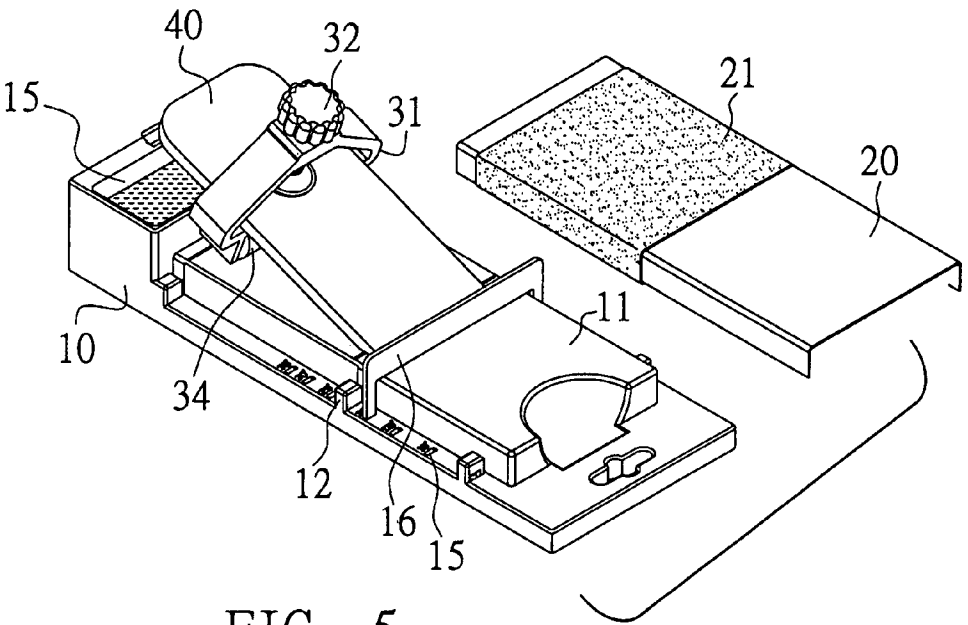
FIG. 5 is a schematic view showing the adjustment of a grinding angle in the first preferred embodiment of the present invention.
Figure 4:
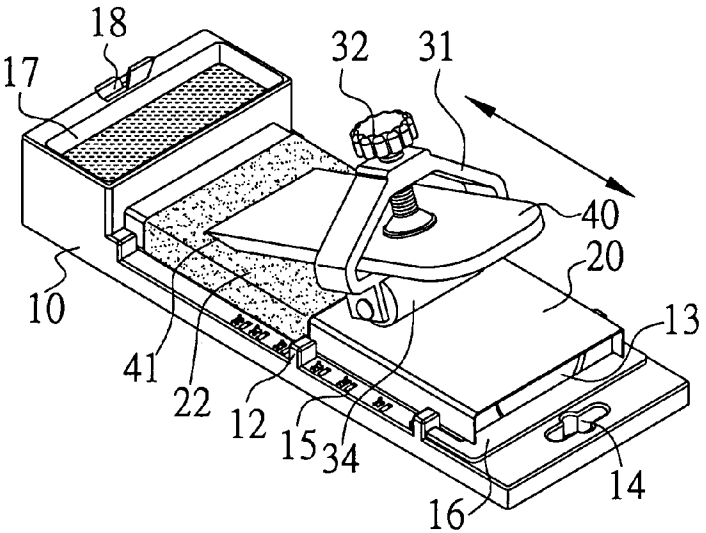
FIG. 4 is a schematic view of the first preferred embodiment of the present invention in use.
Figure 6:
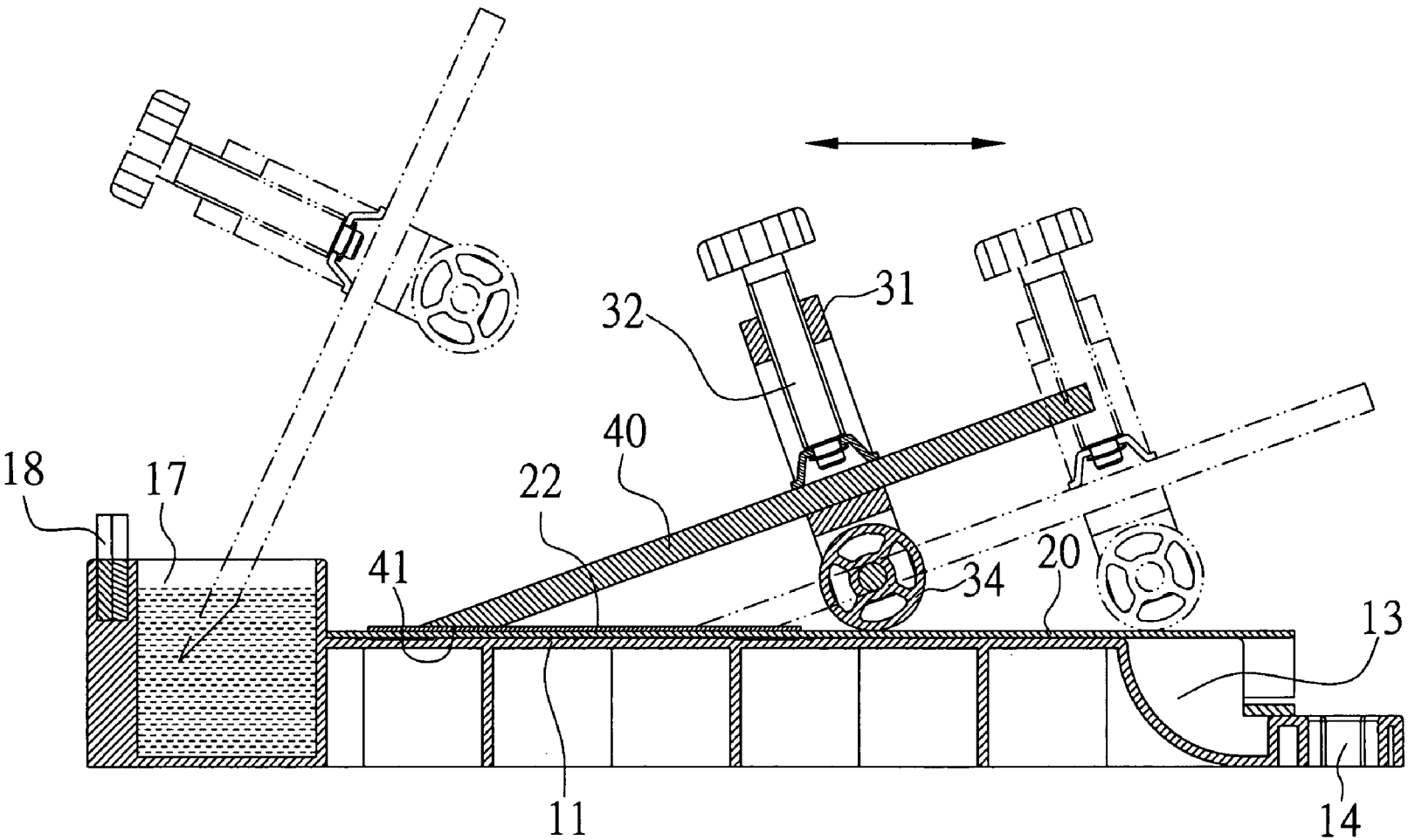
FIG. 6 is a schematic view showing the construction of the first preferred embodiment in use.
Figure 7:
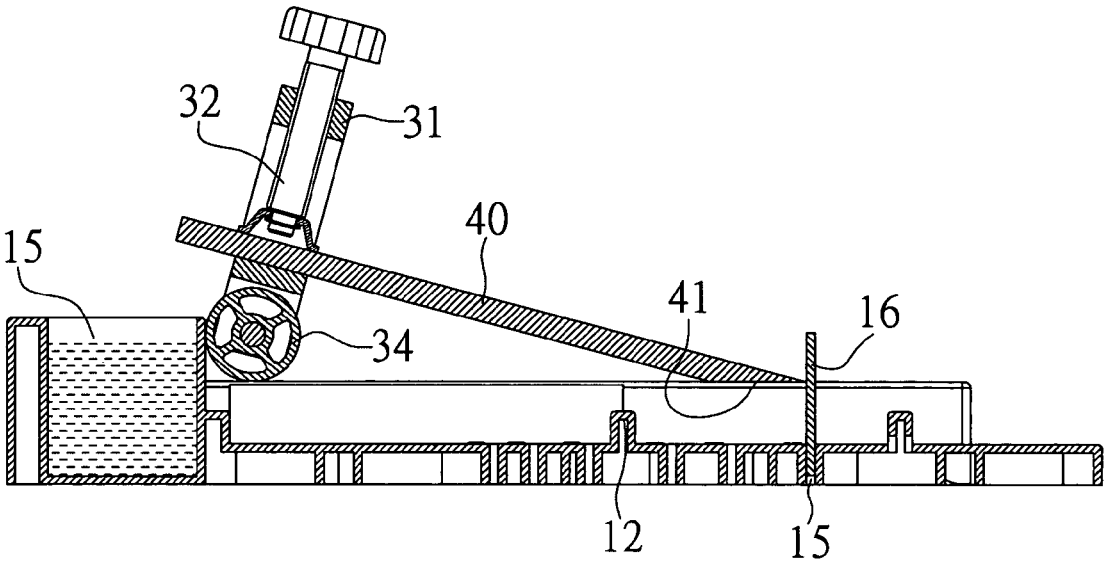
FIG. 7 is a schematic view showing the construction of the first preferred embodiment in adjusting the grinding angle.
Figure 8:
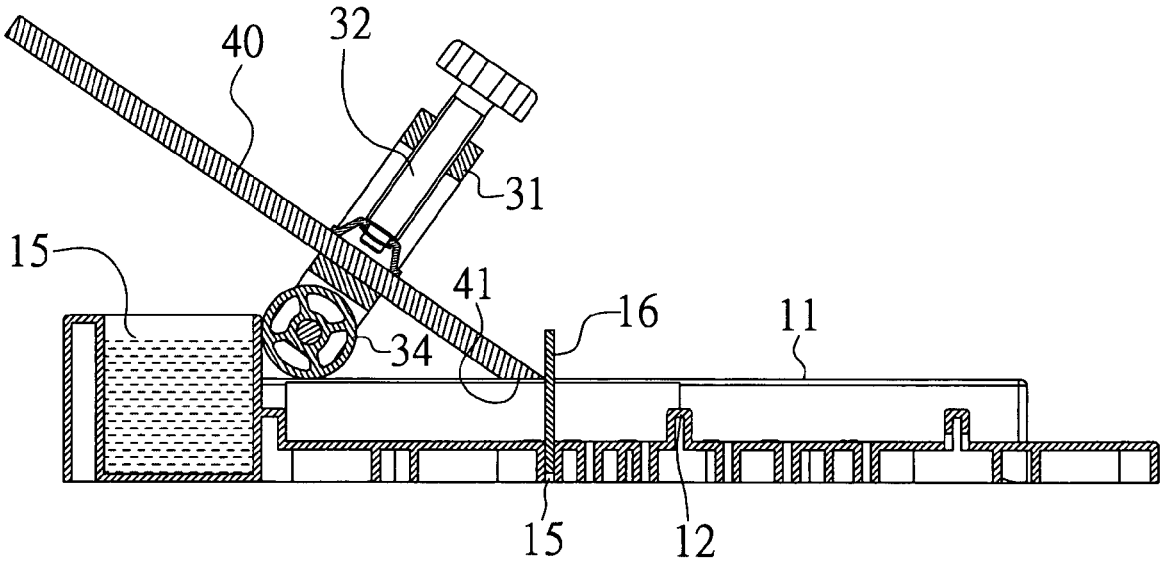
FIG. 8 is a schematic view showing another construction of the first preferred embodiment in adjusting the grind angle.

Referring to FIGS. 1 through 8, a first preferred embodiment of the present invention is essentially comprised of a plastic base (10) injection molded, a mobile base plate (20), and a cutter holder (30). A rectangular deck is disposed on top of the base (10), multiple positioning bits (12) are provided on both sides of the deck (11) and a proper spacing is reserved between each positioning bit (12) and the side of the deck (11) to limit the mobile base plate (20) covering upon the deck (11) in position. A gap (13) is reserved at one end of the deck (11) to facilitate the removing of the mobile base plate (20), and an eyelet (14) is provided on the base (10) at a position close to the gap (13) to facilitate hanging the grinder when not in use. Multiple slots (15) are provided to the base on both sides of the deck (11) to receive insertion of an angle adjustment plate (16) to secure the grinding angle of the cutter. When not required, the angle adjustment plate (16) is stored in a place reserved on the top of the base (10). On the distal end of the base where the eyelet (14) is disposed, a sink (17) containing fresh water is provided and another grinder (18) intended for grinding a pair of scissors is disposed to the outer side of the sink (17) to provide additional function for the grinder of the present invention.

The mobile base plate (20) is made of metal material molded by punching in a dimension approximately identical to that of the deck (11) of the base (10) so to place the mobile base plate (20) on the deck (11). An emery cloth (22) in a given size warps wraps around the mobile base plate (20) and both sides of the emery cloth (22) are inwardly folded along both side plates (21) of the mobile base plate (20) to stay flushed against the inner side of both side plates (21). Accordingly, when the mobile base plate (20) covers upon the deck (11), the mobile base plate (20) and the emery cloth (22) are secured in place by the spacing defined between those positioning bits (12) on both sides of the base (10) and both sides of the deck (11), and further to firmly secure the emery cloth (22) on the mobile base plate (20). The existing emery cloth (22) may be replaced with a new one or another emery cloth (22) with different roughness as required.

The cutter holder (30) includes a frame (31) that can be easily held by one's hand. A cutter (40) is placed in the frame (31) and secured by means of a packing bolt (32) disposed at the top of the frame (31). An axial base (33) extends from the bottom of the frame (31) and a roller (34) is axially provided to the axial base (33) for the cutter holder (30) to roll back and forth on the top of the mobile base plate (20) thus to grind a blade (41) of the cutter (40) against the emery cloth (22).

When assembled, the preferred embodiment of the present invention is ready to grind the cutter (40). First, the cutter (40) is clamped and secured by the cutter holder (30). Before grinding, the roller (34) of the cutter holder (30) rests on the sidewall of the sink (17) containing the fresh water. The packing bolt (32) is loosened up to adjust the cutter (40) for its blade (41) to push against the angle adjustment plate (16) secured in position by those slots (15) for the grinding angle desired. The grinding angle varies depending on the change of relative positions between the cutter (40) and the cutter holder (30) with an error not greater than one degree. The mobile base plate (20) is attached and the roller (34) of the cutter holder (30) is placed to rest on the top surface of the mobile base plate (20) while leaving the blade (41) of the cutter (40) to stay flushed against the grinding surface of the emery cloth (22). The user then holds the cutter holder (30) to grind the blade (41) of the cutter (40) to sharpen it against the emery cloth (22) by following the reciprocal motion of the roller (34) on the top surface of the mobile base plate (20).

In the structural design disclosed above, both of the emery cloth (22) and the mobile base plate (20) are retractable from the deck (11) of the base (10); therefore, once the emery cloth (22) is worn out or another emery cloth with different roughness is required, the mobile base plate (20) can be easily removed from the gap (13) of the deck (11) to replace the existing emery cloth (22).

Figure 9:
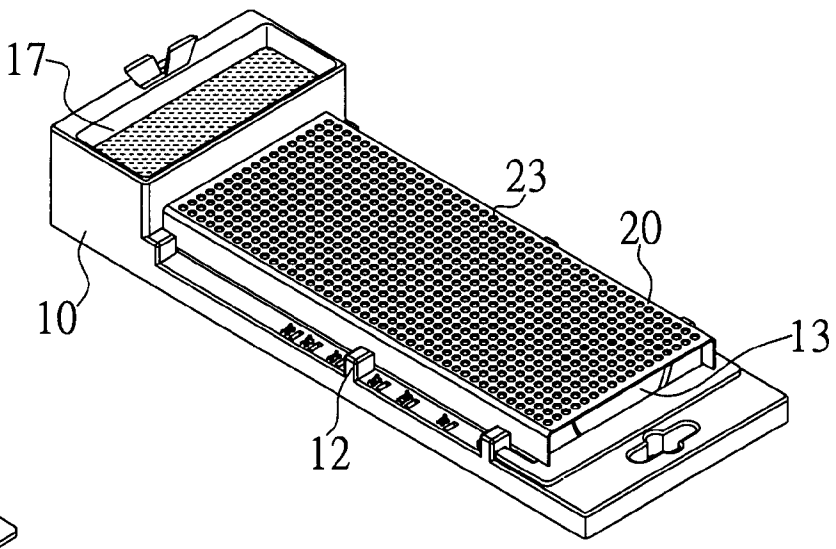
FIG. 9 is an exploded view of a second preferred embodiment of the present invention.
Figure 10:
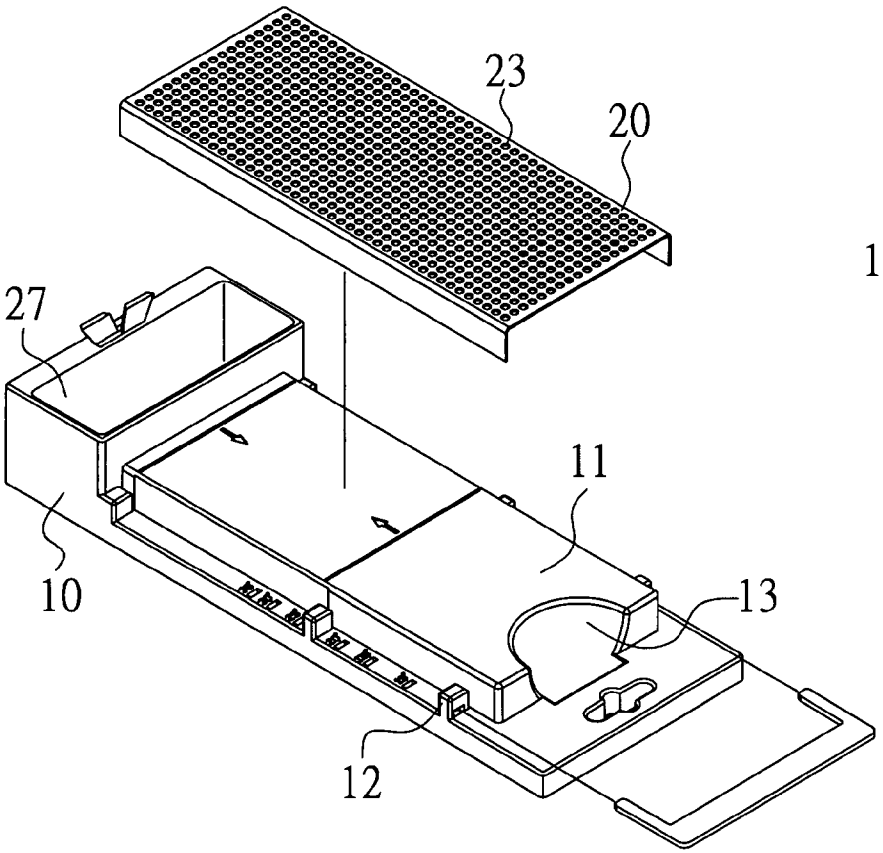
FIG. 10 is a schematic view showing the construction of the second preferred embodiment of the present invention.

As illustrated in FIGS. 9 and 10, a second preferred embodiment of the present invention is also essentially comprised of the base (10) adapted with the deck (11), multiple positioning bits (12), the gap (13) and the sink (17), and the mobile base plate (20). Furthermore, multiple through holes (23) are directly and intensively disposed on the top surface of the mobile base plate (20) with each peripheral of each through hole (23) inlaid with emery to define a grinding surface in place of the emery cloth (22) used in the first preferred embodiment. Whereas the mobile base plate (20) is also retractable, it can be easily replaced with a new one or another one of different roughness.

Figure 12:
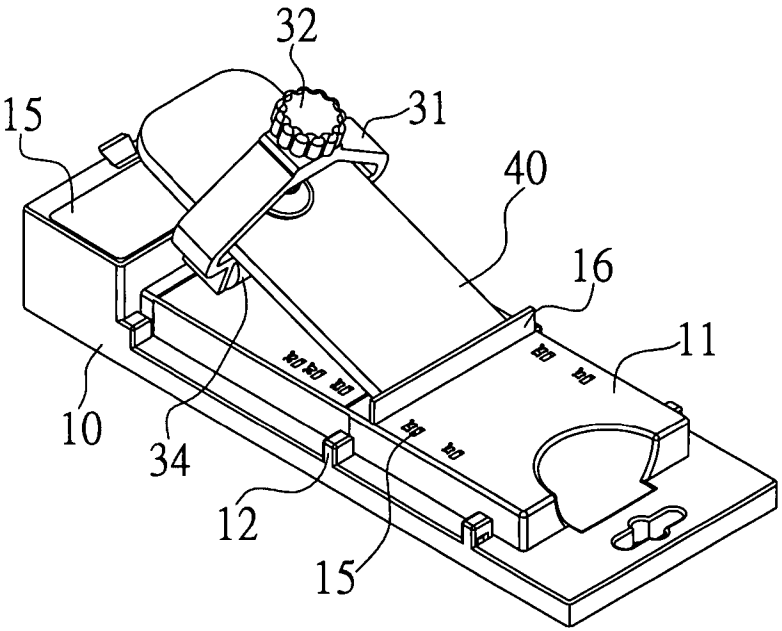
FIG. 12 is a schematic view showing the status of adjusting the grinding angle in the third preferred embodiment of the present invention.
Figure 11:
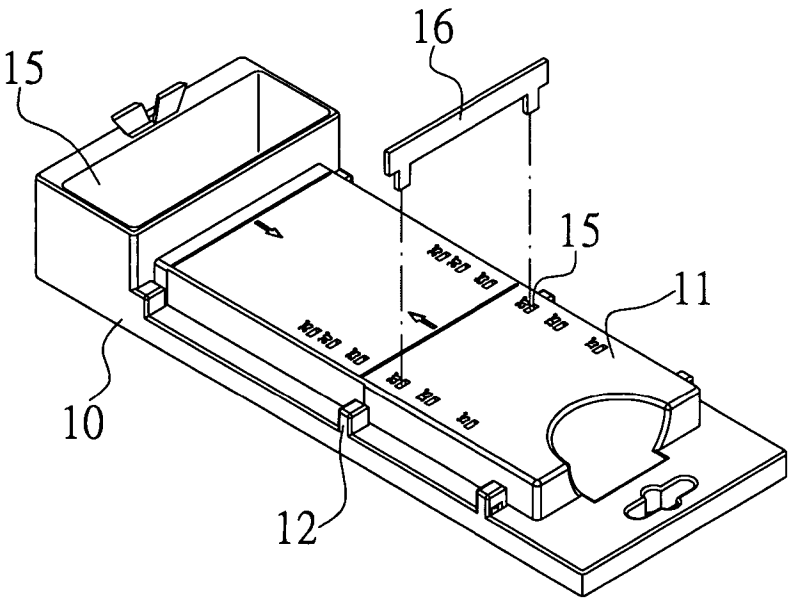
FIG. 11 is a schematic view showing the construction of a third preferred embodiment of the present invention in adjusting the grinding angle.
Figure 14:
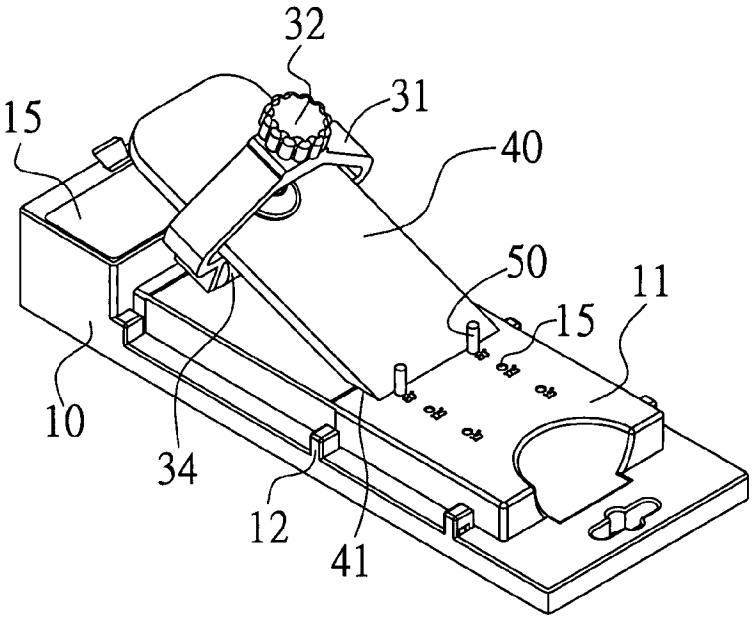
FIG. 14 is a schematic view showing the status of adjusting the grinding angle in the fourth preferred embodiment of the present invention.
Figure 13:
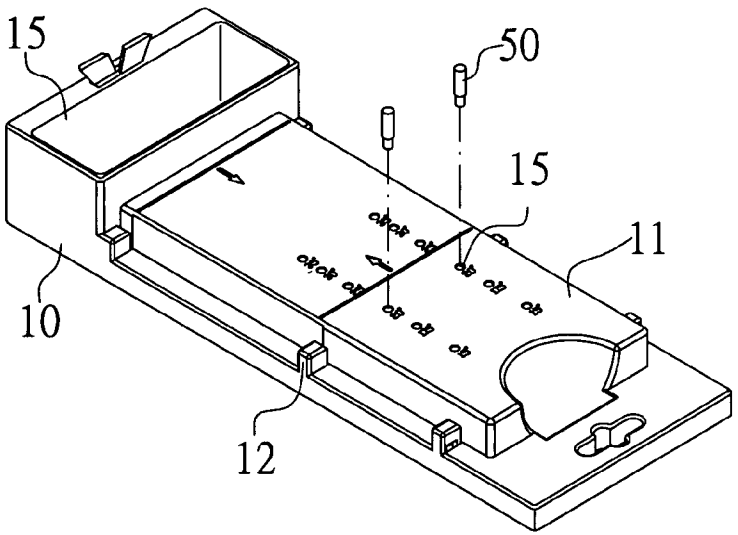
FIG. 13 is a schematic view showing the construction of a fourth preferred embodiment of the present invention in adjusting the grinding angle.
Figure 16:
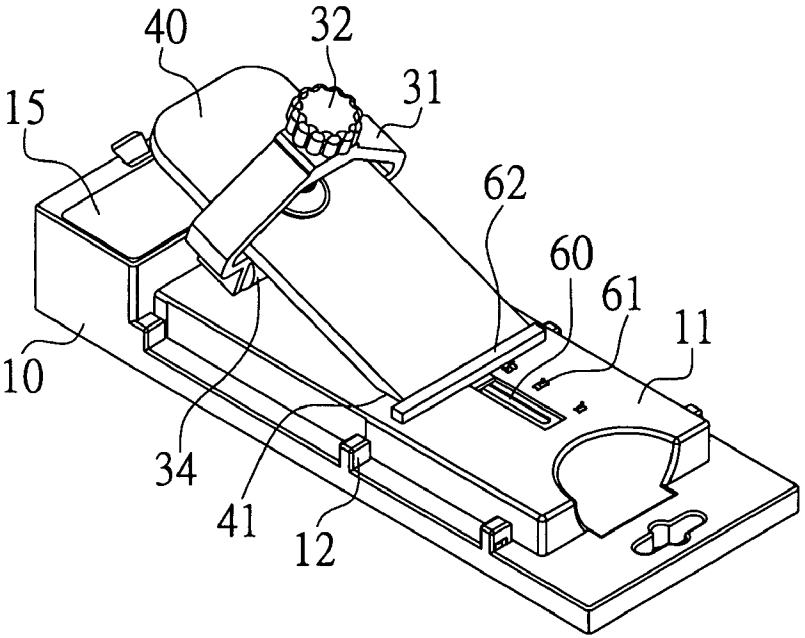
FIG. 16 is a schematic view showing the status of adjusting the grinding angle in the fifth preferred embodiment of the present invention.
Figure 15:
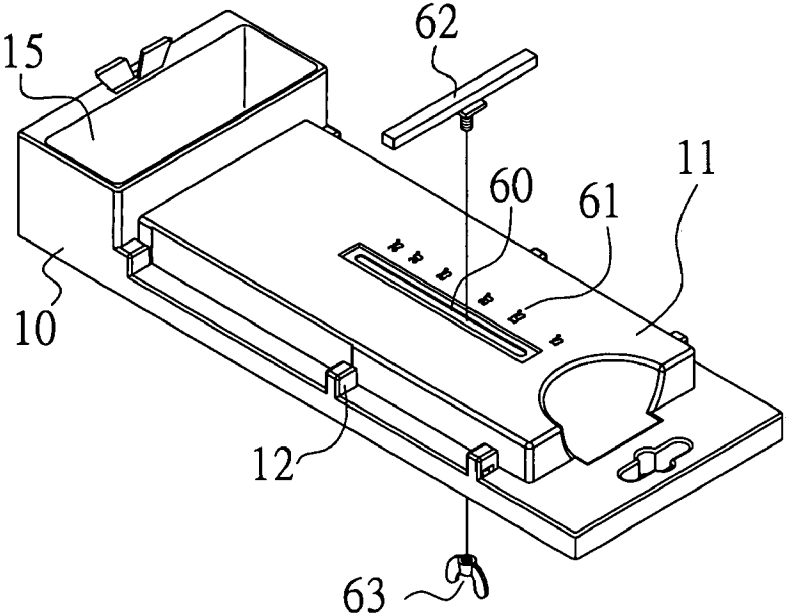
FIG. 15 is a schematic view showing the construction of a fifth preferred embodiment of the present invention in adjusting the grinding angle.
Figure 18:
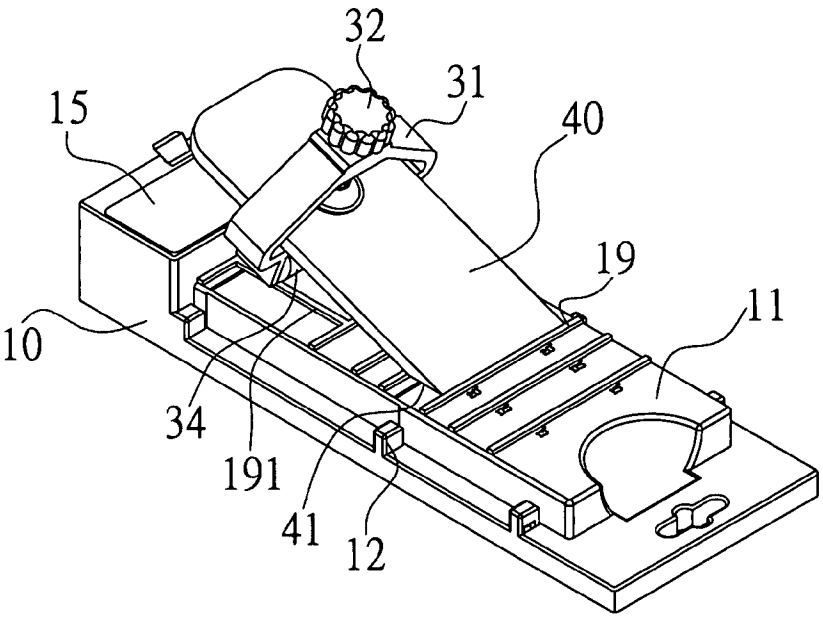
FIG. 18 is a schematic view showing the status of adjusting the grinding angle in the sixth preferred embodiment of the present invention.
Figure 17:
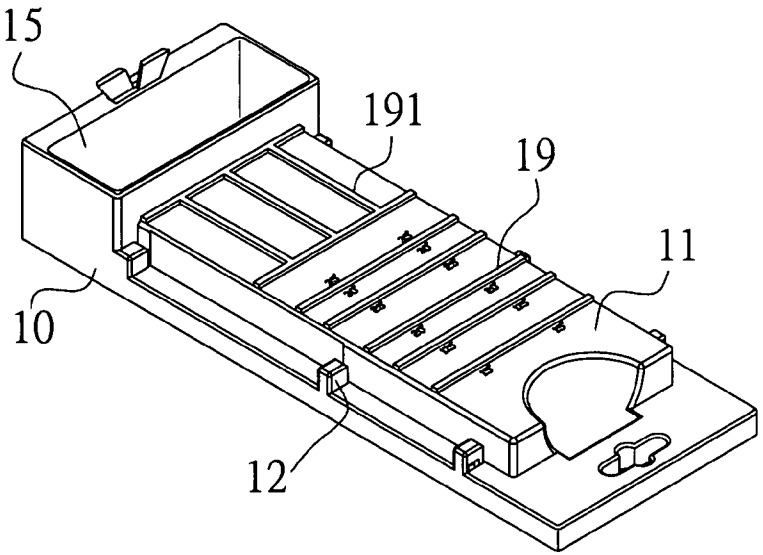
FIG. 17 is a schematic view showing the construction of a sixth preferred embodiment of the present invention in adjusting the grinding angle.

Furthermore, as illustrated in FIGS. 11 through 18 for a plurality of preferred embodiments of the present invention showing the adjustments of grinding angle. Referring to FIGS. 11 and 12, those slots (15) to adjust the grinding angle are disposed on the top of the deck (11) of the base (10) while the size of the angle adjustment plate (16) is reduced as applicable; or as illustrated in FIGS. 13 and 14, a pair of positioning bolts (50) are provided to inserted into the selected pair of those slots (15); or as illustrated in FIGS. 15 and 16, a longitudinal slot (60) is provided on the top surface of the deck (11) of the base (10) and both sides of the longitudinal slot (60) are provided with multiple grades (61), and a limit plate (62) adapted with a nut (63) to adjust the position of the limit plate (62) is provided; or as illustrated in FIGS. 17 and 18, multiple positioning ribs (19) are forthwith formed to adjust the grinding angle on the top surface of the deck (11) of the base (10) to permit the blade of the cutter (40) to hold against those positioning ribs (19) at an angle desired for the blade (41) of the cutter by having the roller (34) of the cutter holder (30) to hold against the sink (17), and multiple ribs (191) are provided vertical to and for a same height as that of those positioning ribs (19) are further disposed on the top surface of the deck (11) at where irrelevant to the adjustment of the grinding angle and closer to the sink (17) for providing consistent support in position when the mobile base plate (20) is placed upon the deck (11) to maintain a firm process of grinding. Now matter what form the angle adjustment plate (16), the positioning bolt (50), the positioning plate (60) the positioning rib (19) is provided for adjusting the grinding angle as described in those preferred embodiments, the relationship among members of the cutter holder (30), the cutter (40) and the angle adjustment plate (16) shall be adjusted by following the principle of trigonometric function for easy adjustment of the preferred grinding angle of the blade (41) of the cutter (40) in achieving consistent and reliable grinding quality.

The present invention by taking advantage of a mobile base plate that is retractable to be covered up with an emery cloth before being placed upon a deck of the base of the grinder to secure the emery cloth and permit easy replacement of the emery cloth; the cutter to be ground being clamped and secured by a cutter holder disposed at its bottom a roller for the user to grip the cutter holder in moving back and forth on the surface of the mobile base plate to grind the blade of the cutter against the emery cloth at a grinding angle as desired by having provided angle adjustment plate or positioning rib using the slots disposed on both sides or on the top surface of the deck of the base in making the grinding easier while maintaining grinding safety, maintains excellent grinding quality for industrial purpose.

The invention claimed is:

1. A cutter grinder for grinding a blade of a cutter, comprising:

a base having a rectangular deck on a top thereof, a plurality of positioning bits being disposed on both sides of the deck, with a spacing being provided between the positioning bits and both sides of the deck;

a mobile base plate covering the deck and being retained in position by both sides of the deck and the positioning bits to prevent the mobile base plate from being easily disengaged from the deck, the mobile base plate having a top surface having a dimension substantially identical to that of the deck of the base, the mobile base plate being adapted to be covered with a piece of emery cloth of a given dimension, both the emery cloth and the mobile base plate being holdable in position by the spacing between the positioning bits and both sides of the deck, the emery cloth being firmly positionable on the mobile base plate and being removable to allow for a replacement with a new emery cloth or another one with a different roughness; and a cutter holder comprised of a frame adapted to be gripped, the cutter being positionable in the frame, a packing bolt disposed at a top of the frame; the cutter being securable to the frame using the packing bolt, an axial base extending from a bottom of the frame, and a roller axially provided on the axial base, the cutter holder being movable back and forth on the top surface of the mobile base plate while rolling on the roller to grind the blade of the cutter.

2. The cutter grinder of claim 1, wherein the mobile base plate comprises a first mobile base plate; further comprising a second mobile base plate that replaces the first mobile base plate, the second mobile base plate having a top surface having a plurality of through holes, emery being inlaid on an inside of each through hole to constitute the grinding surface in place of the emery cloth.

3. A cutter grinder, comprising:

a base having a rectangular deck, a plurality of positioning bits being disposed on both sides of the deck, with a spacing being provided between the positioning bits and both sides of the deck, the base further including a sink disposed at one end thereof and adjacent to the deck, the sink being adapted to contain a liquid and being disposed at a level higher than a top surface of the deck;

a mobile base plate covering the deck and being retained in position by both sides of the deck and the positioning bits, the mobile base plate having an upper surface having a dimension substantially identical to that of the deck of the base, and a piece of emery cloth of a given size covering the mobile base plate to define a grinding surface;

a cutter holder comprised of a frame adapted to be gripped, a cutter being positionable in the frame, a packing bolt disposed at a top of the frame; the cutter being securable to the frame using the packing bolt, an axial base extending from a bottom of the frame, and a roller being axially provided to on the axial base, the cutter holder being movable back and forth on the top surface of the mobile base plate while rolling on the roller to grind the blade of the cutter against the emery cloth; and angle adjustment means disposed on the deck of the base for adjusting a grinding angle of a blade of the cutter, a preferred grinding angle being attained by positioning the roller of the cutter holder to rest against a sidewall of the sink, and positioning the blade of the cutter against an angle adjustment device, while the packing bolt is loosened.

4. The cutter grinder of claim 3, wherein the angle adjustment device is mounted to the deck of the base and is arranged depending on a trigonometric function value defined by the cutter holder, the cutter, and the deck.

* * * * *